US005209198A

United States Patent [19]

Bedi

[11] Patent Number: 5,209,198

[45] Date of Patent: May 11, 1993

[54] PROCESS FOR SIMPLE AND HIGH SPEED OIL CHANGE AND/OR FLUSHING THE ENGINE OIL DISTRIBUTION CHANNELS OF THE MOVING COMPONENTS OF THE CRANKCASE IN AN INTERNAL COMBUSTION ENGINE

[75] Inventor: Ram Bedi, Birmingham, Mich.

[73] Assignee: K.J. Manufacturing Co., Wixom, Mich.

[21] Appl. No.: 413,008

[22] Filed: Sep. 26, 1989

Related U.S. Application Data

[63] Continuation-in-part of Ser. No. 350,303, May 11, 1989, Pat. No. 4,884,660.

[51] Int. Cl.[5] ..... F01M 1/00

[52] U.S. Cl. ..... 123/196 R; 184/1.5

[58] Field of Search ..... 123/196 R, 196 A; 184/1.5

[56] References Cited

U.S. PATENT DOCUMENTS

| | | | |
|---|---|---|---|
| 1,886,098 | 11/1932 | Hedglon . | |
| 2,158,914 | 5/1939 | Rinehart | 184/1.5 |
| 2,249,303 | 7/1941 | Smith | 184/1.5 |
| 2,320,048 | 5/1943 | Parson | 184/1.5 |
| 2,366,073 | 12/1944 | Vallerie | 184/1.5 |
| 2,425,848 | 8/1947 | Vawter | 184/1.5 |
| 2,454,585 | 11/1948 | Alderman | 184/1.5 |
| 2,554,389 | 5/1951 | Stevens | 184/1.5 |
| 2,594,779 | 4/1952 | Huffman | 184/1.5 |
| 3,489,245 | 1/1970 | Broadwell | 184/1.5 |
| 4,674,456 | 6/1987 | Merritt | 184/1.5 |
| 4,776,431 | 10/1988 | Poling | 184/1.5 |
| 4,807,674 | 2/1989 | Sweet | 184/1.5 |
| 4,854,277 | 8/1989 | Kenney | 184/1.5 |

*Primary Examiner*—E. Rollins Cross
*Assistant Examiner*—Erick Solis
*Attorney, Agent, or Firm*—Basile and Hanlon

[57] ABSTRACT

A process and apparatus for changing the oil in an engine and/or flushing and scrub cleaning the moveable parts in the engine utilizing the internal lube oil distribution system of the engine. The device includes an oil filter adapter adapted to be positioned in the oil filter boss, a remote oil filter mounting boss and inlet and outlet hoses connecting the two. The device is attached to the engine. Suitable pump-out and fill lines are connected to the device and can be releasably attached to an external pump device. When the device is employed to change oil, the external pump device is connected, and spent oil removed from the oil pan under suction force through the pump-out line. A measured amount of fresh oil is then introduced through the fill line and the internal lube oil distribution system. Once accomplished, the external pump device can be uncoupled. When thorough cleaning is required, a suitable flushing fluid is introduced under pressure through the fill line and the internal oil distribution system after the spent oil is pumped out to scrub clean the internal passages and surfaces. The flushing fluid can be recirculated as desired to achieve thorough cleaning and, then, removed through the pump-out line.

8 Claims, 3 Drawing Sheets

PROCESS FOR SIMPLE AND HIGH SPEED OIL CHANGE AND/OR FLUSHING THE ENGINE OIL DISTRIBUTION CHANNELS OF THE MOVING COMPONENTS OF THE CRANKCASE IN AN INTERNAL COMBUSTION ENGINE

CROSS-REFERENCE TO RELATED APPLICATIONS

This application is a continuation-in-part of Ser. No. 07/350,303 filed on May 11, 1989, now U.S. Pat. No. 4,884,660.

BACKGROUND OF THE INVENTION

1. Field of the Invention

This invention relates to a method and device for changing motor oil, and, optionally, flushing the motor oil reservoir and crankcase components in internal combustion engines of all sizes. Such internal combustion engines can be found on automobiles, trucks, tractors, heavy earth moving equipment, military equipment, stationary equipment or the like. More particularly, this invention relates to processes in which residual spent oil and other contaminants which adhere to the surfaces of the internal engine oil distribution channels of the engine components such as the crankshaft, bearings, connecting rods, etc, in the crankcase are expediently removed. This invention also relates to a device and method for removing the degraded spent motor oil and replacing it with a suitable amount of fresh motor oil in an integrated self-contained process at high speeds with almost no exposure to the oil vapors of the spent fresh engine oil.

2. Background of the Relevant Art

The benefits of routine oil changes to internal combustion engines are well known. Routine oil changes have been shown to increase engine life and performance. With repeated prolonged use, motor oil builds up metallic and non-metallic suspended particles from the abrasive and or adhesive wear of engine parts against one another and from products of incomplete combustion and improper air intake. The particles, in turn, cause abrasive wear of the engine bearings, piston rings and other moving parts and result in the reduction of the motor oil lubricity as various additives and lubricating components become depleted. This adversely effects engine performance and, if left unchanged, can destroy or cripple the engine performance.

It is recommended by at least one oil manufacturer that the level of total solid concentration be limited to levels below 3.0% with levels of silica being present in amounts lower than 25 ppm and sodium in amounts lower than 200 ppm.

To obtain satisfactory automotive engine performance, and maintain solid concentration levels in the motor oil lower than the recommended 3.0%, changing the motor oil in an automobile engine is a necessary, but an undesirable, dirty, and time-consuming task. As vehicles are designed, the oil pan serves the purpose of a reservoir for circulation of engine oil. Engine oil is drawn from the oil pan where it is pumped under pressure through internal oil distribution passages drilled in the engine block, crank shaft, connecting rods, bearings, etc. The oil exits the internal oil distribution passages through various carefully positioned openings to lubricate the reciprocating and rotating parts of the engine. The motor oil, then drains back to the oil pan for recirculation. To prolong oil usefulness, the oil is passed through an oil filter mounted on the engine generally at the bottom of the engine block. Once the oil becomes contaminated, the spent oil must be changed to prolong engine life. For higher compression engines, to increase gas mileage, frequent oil changes become even more important.

In the conventional oil change process the drain plug, located in the lowermost region of the oil pan, is opened. The degraded (spent) oil containing suspended particles is permitted to flow under gravity out of the pan into a suitable receptacle. After the spent oil is removed, the used oil filter can be removed and replaced. The drain plug can, then, be replaced and fresh oil added to the engine; usually through a separate opening, such as in the engine valve cover.

The process of gravity drainage does not remove all of the spent oil with its metallic and non-metallic particulates because gravity drainage provides only minimum scrub cleaning or scouring action and cannot dislodge strongly adhering particulates and degraded oil components. A significant portion sticks to the oil pan walls, as well as to the surfaces and passages of engine components such as the crank shaft, connecting rods, pistons engine block, cylinder head and the like. These particles remain to be mixed with fresh motor oil. Thus the concentration of contaminants is lowered by dilution and only a part of the total contaminants are eliminated.

The oil change process is essentially the same whether performed at home, at service stations or at one of the various so called rapid oil change centers which have opened in recent years. Spent or dirty oil is allowed to collect in the oil pan and is, then, permitted to drain from the oil pan through the drain plug opening located in the lowermost portion of the oil pan. The drain plug opening is, then, closed and fresh oil is added to the crankcase and oil pan through a suitable opening such as the valve cover.

In this basic procedure, the oil pan and crankcase never drain completely. Oil containing suspended, gelatinous, and sticky particles remains on the walls of the pan and the surfaces of the crankcase components, and in the various oil distribution passages, to mix with the fresh oil added during the conventional oil change process and subsequent engine use. This reduces the life of the oil filter which, in turn, further reduces the life of the engine itself over an extended period of time.

Removal of the used oil filter is also a messy and undesirable procedure. The used filter must be unscrewed and removed without spilling the large amount of oil remaining within it.

The oil change process is essentially the same whether performed at home, at service stations or at one of the various so called rapid oil change centers which have opened in recent years. They advertize themselves as quick oil change or ten-minute oil change centers. These so called "Rapid Oil Change" centers are faster than other automotive service centers simply because they focus their total service business on oil changes only and are more efficient simply because they are organized to do so. The rate of oil drainage and oil fill rates are the same as those of service stations because of the constant drainage and filling force limited by gravity. Also, these oil change centers do not clean the crankcase components any better than other conventional oil change processes. Thus, while in stations and rapid oil change centers, the process can be simplified with the use of hydraulic racks, special oil collection receptacles and the like, the basic procedure of drainage through a restricted drain opening and oil replacement through a separate opening is standard and as is gravity.

This basic procedure has several drawbacks. It is time-consuming. The speed with which the oil drains through the drain valve is limited by the restrictive opening and gravity. In commercial settings, this can detain personnel and valuable, expensive resources such as hydraulic racks while waiting for the oil to drain. As previously indicated, the oil pan never drains completely. Oil containing suspended and sticky particles adheres to the walls of the pan to be mixed with the new oil added. This reduces the life of the oil filter which further reduce the life of the engine itself over extended use for a period of years.

The basic process is also messy and exposes the operator to undesirable oil vapors. The drained oil must be moved, handled and, ultimately, disposed of in an appropriate manner. Drainage into open containers increases the opportunities for spillage and mishandling and exposure. Fresh oil introduced into the opening in the engine valve cover can be accidentally spilled in the engine compartment. The spilled oil can smoke and burn if spilled on the manifold and can attract dirt and grime, regardless.

Many processes and devices have been proposed to remove residual oil and contaminants from the oil pan and/or crankcase components. U.S. Pat. No. 2,554,389 to Stevens discloses a crankcase cleaning apparatus which has a non-retractable spray wand which is adapted to extend into the oil pan through the drain plug opening and be fixed relative thereto. An unspecified cleaning fluid is sprayed under pressure through the wand to contact the interior surfaces of the oil pan and limited portions of the crankcase to dislodge any residual contaminants. The fluid and dislodged contaminants are allowed to drain out through the drain plug opening and are collected in a liquid receiver situated on the exterior of the oil pan for collection and eventual reuse. The fixed wand in this device does not permit efficient and complete cleaning of the interior lube passages of the crankcase components whatsoever. Additionally, the manner in which the cleaning fluid is collected brings with it an elevated risk of spillage.

U.S. Pat. No. 3,489,245 to Broadwell discloses an apparatus for flushing oil pans of internal combustion engines after the spent oil has been removed from the pan. Flushing fluid can be introduced into the oil pan and crankcase through a spray nozzle which is mounted in the drain plug opening. The device disclosed in Broadwell does not permit introduced cleaning fluid to thoroughly contact the interior surfaces and passages of the crankcase components and the oil pan and dislodge adhering solid and oil contaminants and oil. The spray nozzle apparatus disclosed in the Broadwell reference includes a complex recirculating system to pump and process the sprayed cleaning fluid. This system can never completely remove all residual oil and cleaning fluid which accumulates in the bottom of the oil pan opening and nozzle assembly. Furthermore the system cannot be used to accomplish an oil change.

U.S. Pat. No. 2,594,779 to Huffman discloses a crankcase cleaning device in which a spray nozzle is attached to a fitting which can be screwed into the drain plug opening when the spray nozzle is used. A suitable cleaning fluid is directed onto the surfaces of the crankcase and the oil pan to remove contaminants. The crankcase can then be prelubricated by spraying a suitable lubricating agent through the spray nozzle onto the newly cleaned surfaces. Once this is done, the nozzle device is removed. The spent cleaning fluid and residual prelubricating liquid are, then, allowed to drain from the oil pan through the drain plug opening. As with the Stevens and Broadwell references, the device disclosed in Huffman lacks the ability to completely and safely remove residual contaminants remaining in the lube passages of and surfaces of the moving engine components and also lacks a method for rapid efficient oil change.

U.S. Pat. No. 1,886,098 to Hedglon discloses an oil change system which is particularly adapted to stationary engines. The device disclosed in Hedglon includes a drain pipe permanently disposed in the drain opening of the engine. The drain pipe is permanently connected to suitable storage reservoirs and waste storage reservoirs by means of a suitable pipe. All lubricating and flushing fluids enter and leave the crankcase and oil pan by way of the drain pipe. This configuration makes it extremely difficult to contact remote regions of the crankcase with flushing fluid or introduced lubricating oil. Additionally, the system does not provide a means whereby introduced flushing fluid can be filtered and recirculated. Finally the Hedglon reference is silent about handling and disposal of the engine oil filter.

As can be appreciated, none of these devices present an integrated and efficient method for cleaning and lubricating the various recessed surfaces such as lube passages of the crankcase and oil pan and changing the engine oil at high speed.

Thus, it would be desirable to provide a process which accelerates removal of spent oil, associated contaminants, and degraded oil additives to permit eventual replacement with fresh engine oil in an essentially clean container in a unified process at one single location in an associated vehicle. It is also desirable to provide a method and device by which an oil change or oil change and crankcase components flushing operation can be accomplished which also eliminates the amount of spent and fresh oil handling and exposure. Finally it is desirable to provide a process which could easily be employed by the vehicle owner with all the benefits of the method of the present invention such as time saving, convenience, no spills, cleaner oil pans and engine components parts, with a minimum or no exposure to motor oil and, finally, longer lasting engines.

SUMMARY OF THE INVENTION

The present invention is a process and apparatus for high speed oil change in an internal combustion engine having a crank case and an oil pan. The process can also include optional flushing steps.

The device of the present invention includes an oil filter adapter sealingly connected to the oil filter mounting boss located integrally in the engine block. The adapter has at least two nozzles to which a first inlet hose and a second outlet hose are attached. The first inlet hose and second outlet hose are connected to a remotely disposed oil filter mounting boss to which the engine oil filter can be sealingly mounted. The remotely disposed mounting boss has a bracket which can be attached to the exterior surface of the cylinder head or engine block or any readily accessible position.

The device also includes a pump-out hose which is attached to the drain opening of the oil pan. The pump-out hose has a suitable quick connect suction fitting which can be releasably connected to an external pump device which can direct the fluid flow at will. The pump-out hose is also connected to the first inlet hose to permit recirculation of fluids through the oil filter when desired.

The second outlet hose has a first end connected to the remotely disposed mounting boss and a second end attached to the oil filter adapter in a manner which permits the second outlet hose to be in fluid communication with the internal lube oil circulation passages in the various engine components. A fill line having a suitable quick connect pressure coupling is connected to the second outlet hose a location either downstream or upstream of the oil filter between the oil filter and the engine.

In the method of the present invention, a rapid efficient oil change can be performed using the device described previously by connected the quick connect pressure and suction members to mating members on a suitable external pump device. Once connected, a suction force can be exerted through the pump-out line to remove spent oil collected in the oil pan. Once the spent oil is removed if desired, the old oil filter is replaced with a new filter and an appropriate amount of fresh motor oil is introduced under pressure into the internal lube oil circulation passages through the fill line and the second outlet hose. The pumping pressure is sufficient to permit contact between the fresh oil and the moveable engine parts. The amount of fresh lube oil introduced is that which is appropriate for the respective engine. After the fresh oil is introduced the coupling members are removed and normal oil circulation through the filter can commence.

Where thorough crankcase cleaning and flushing is required, a suitable flushing fluid may be introduced through the fill line and second outlet hose at any time before, during or after removal of the spent oil. The flushing fluid is introduced under sufficient pressure to induce a spraying pattern which facilitates contact between the flushing fluid and all remote surfaces of the crankcase components. Flushing fluid introduced after removal of spent oil may be filtered to remove particulate contaminants and reintroduced to the crankcase until cleaning is complete.

After cleaning is complete, the flushing fluid can be removed and fresh motor oil introduced in the manner described previously.

BRIEF DESCRIPTION OF THE DRAWING

In the present description, reference is made to the following drawing in which like reference numerals are used to refer to like elements throughout the similar views and in which.

DESCRIPTION OF THE PREFERRED EMBODIMENT

The basic process of the present invention can be employed successfully with vehicles or stationary power plants having internal combustion engines which have oil pans or similar oil reservoirs and internal lube oil distribution systems. The term "internal oil lube distribution passage system" is defined as, but not limited to, the machined passages and circulation systems present in the engine block, cylinder head, crank shaft, cam shaft and connecting rods. Various engines will have differing lubrication requirements. Therefore it is understood that every engine may not have passages or circulation systems in all the enumerated components.

THE APPARATUS

Figure 1:
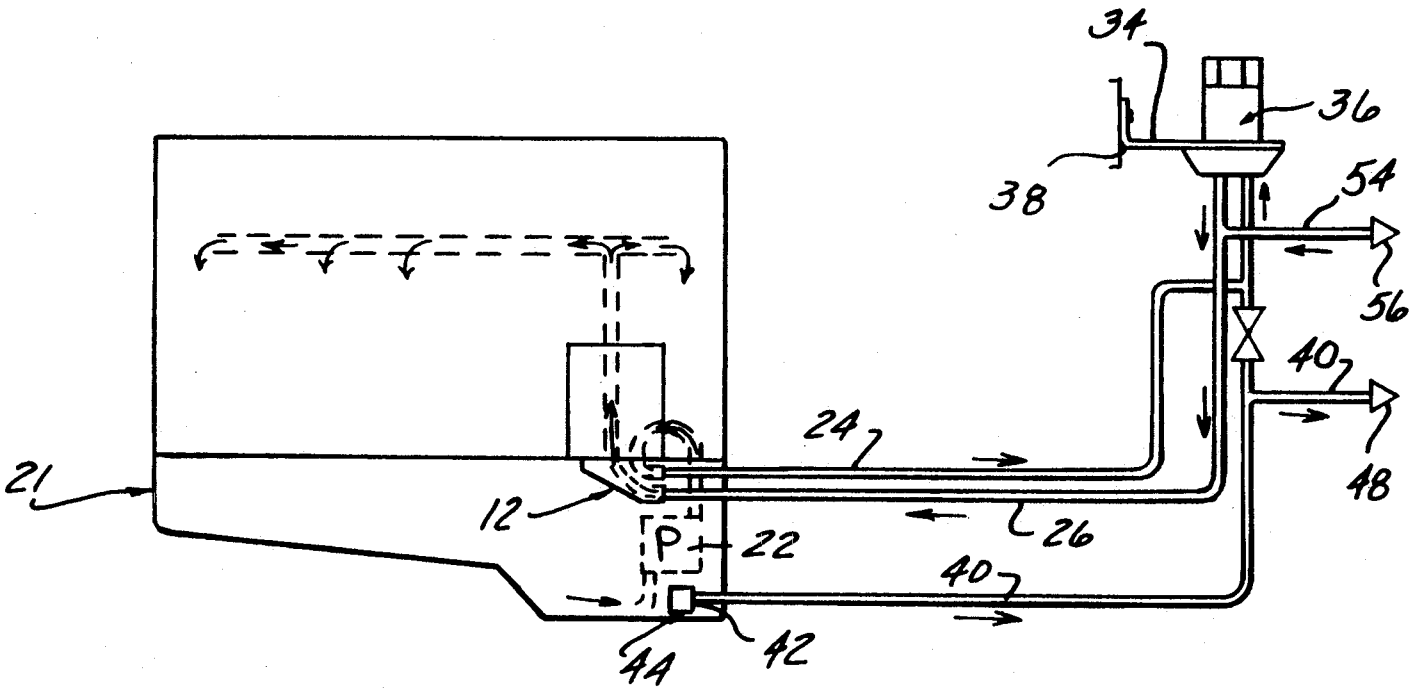
FIG. 1 is a schematic representation of the device of the present invention.
Figure 2:
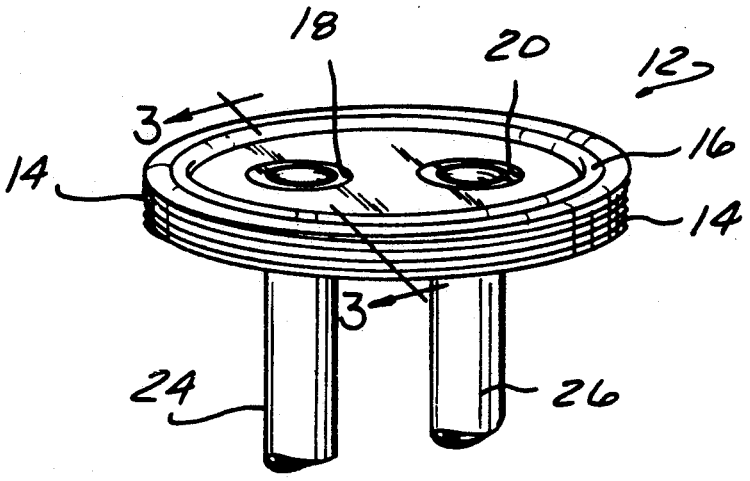
FIG. 2 is a detail drawing of the top view of oil filter adapter of the present invention.
Figure 3:
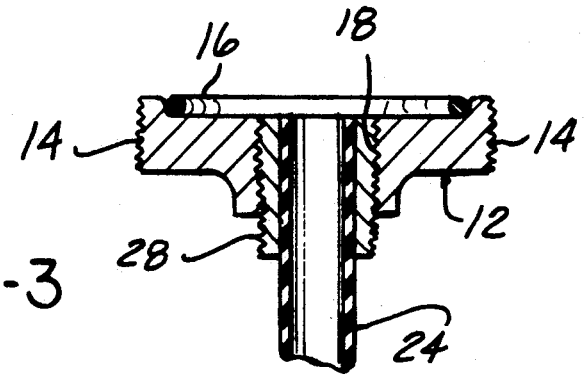
FIG. 3 is a cross-sectional view of the oil filter adapter taken along the 3—3 line of FIG. 2.
Figure 4:
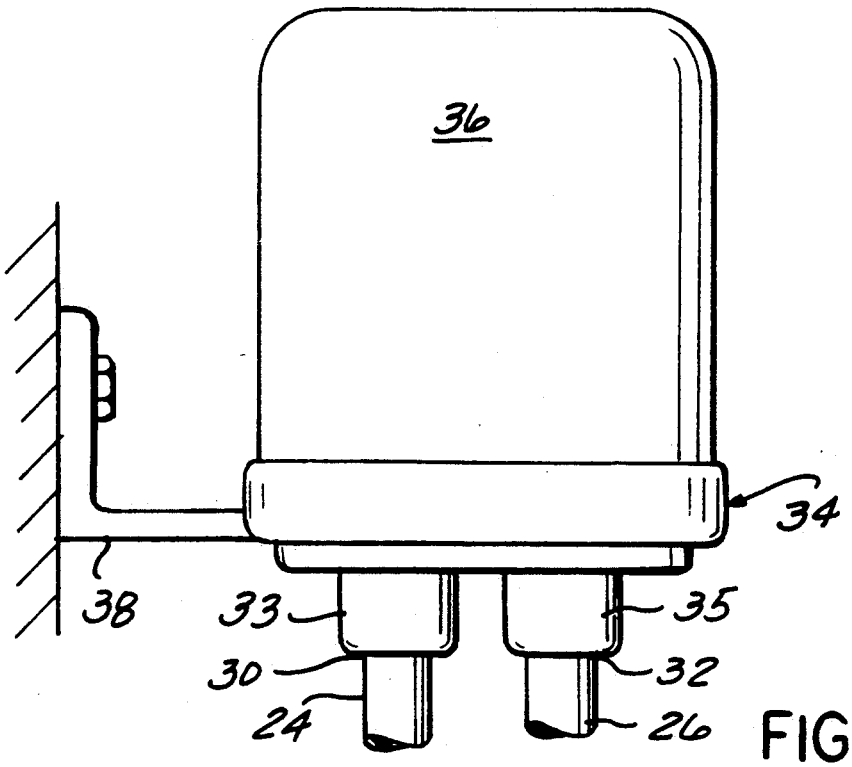
FIG. 4 is a detail drawing of the oil filter and remote oil filter mounting boss.

The apparatus 10 of the present invention, depicted schematically in FIG. 1, includes an oil filter adapter 12 shown in detail in FIG. 2 and 3. The oil filter adapter 12 has an exterior threaded surface 14 and a suitable sealing member such as sealing gasket 16 which will permit it to be inserted into the oil filter mounting boss located in the engine block of the associated internal combustion engine not shown. The oil filter adapter 12 has at least two nozzles, a first inlet nozzle 18 and second outlet nozzle 20 through which introduced fluids may flow. The first inlet nozzle 18 is in fluid communication with the engine oil pump 22 located in oil pan 21 while the second outlet nozzle 20 is in fluid communication with the internal lube oil distribution passage system of the moving engine components.

The detailed configuration of one nozzle 18 is shown in FIG. 3. It is to be understood that nozzle 20 may be similarly configured. Furthermore, it is to be understood that nozzles 18, 20 may be shaped or have additional components such as elbows or the like to permit easy installation in the engine compartment of a vehicle. As shown in FIGS. 2 and 3, nozzles 18 and 20 have first inlet hose 24 and second outlet hose 26 attached to them. Inlet hose 24 has a suitable fastening means such as threaded end 28 which can be sealingly received in nozzle 18. Outlet hose 26 may be similarly fastened.

Inlet hose 24 and outlet hose 26 terminate in second ends 30 and 32, respectively, which are attached to a remote oil filter mounting boss 34 to which oil filter 36 is sealingly attached. The remote oil filter mounting boss 34 generally has nozzles 33, 35 which are configured similarly to those in the oil filter adapted 12. Remote oil filter mounting boss 34 will generally have internal threads (not shown) to receive the oil filter 36. Remote boss 34 also has a mounting bracket 38 to permit mounting of the remote boss 34 to a suitable and accessible area of the exterior engine wall such as the crankcase cover. The remote boss 34 is preferably oriented to permit the filter 36 to be positioned essentially upright so that the oil filter opening is facing downward. This permits drainage of fluid form the filter 36 which facilitates clean removal of the oil filter 36.

The inlet hose 24, outlet hose 26 and oil filter 36 make a circuit through which oil is pumped during engine operation. The oil pump 22 circulates the engine oil from oil pan 21, through inlet hose 18, through filter 36 and on to the various engine components through outlet hose 26 and the internal engine oil distribution passage system during conventional engine operation.

Figure 5:
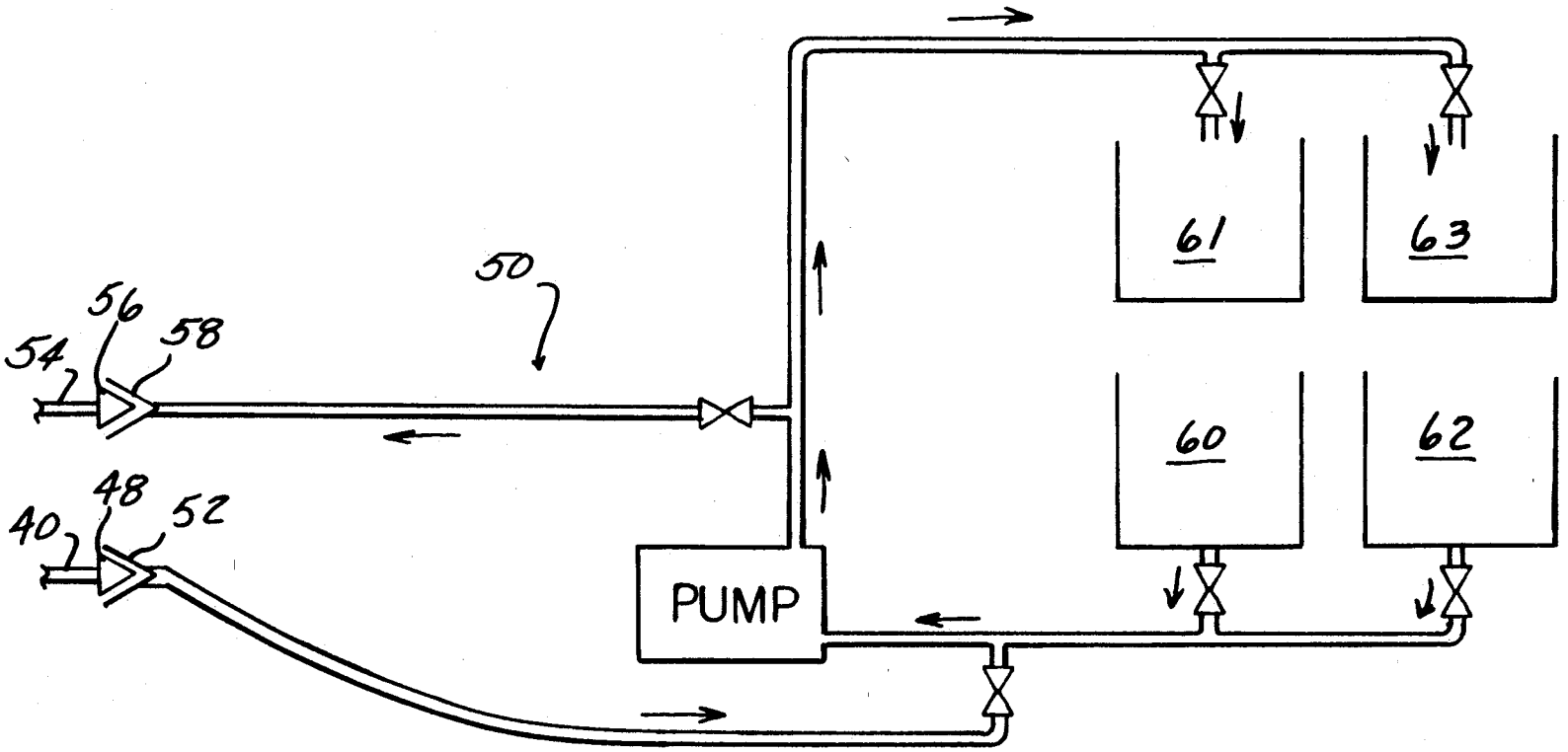
FIG. 5 is a schematic representation of the external recirculation pump employed in the present invention.

The device 10 of the present invention also includes a pump-out line 40 which has a first section 42 connected to oil pan 21 at the drain plug opening 44 of oil pan 21. Pump-out line 40 may also include a second section which is connected to inlet hose 24. Pump-out line 40 terminates in a quick connect suction coupling 48 adapted to be matingly received in a suitable coupling 52 on the external pump device 50 shown in FIG. 5 and described in detail subsequently.

A fill line 54 is connected to the outlet hose 26. The fill line 54 may be connected to the outlet hose 26 either upstream or downstream of the filter 36. Fill line 54 has a quick connect suction coupling 56 adapted to be matingly received in a suitable coupling 58 on the external pump device 50.

The external pump device 50 includes suitable storage tanks 60, 62 for holding flushing fluid, fresh motor oil and optional reservoirs for containing spent fluids 61, 63. The external pump device 50 is capable of producing sufficient pumping pressure to introduce flushing fluid or fresh motor oil into the engine in a spray pattern to administer the introduced material over the engine components, the oil pan interior and the lube passages in a scrub cleaning action thereby cleaning or lubricating the contacted surfaces depending upon the process being implemented.

THE PROCESS

In order to better understand the device 10 of the present invention, the oil change and crank case flushing process will now be discussed making reference to the various parts of the device 10 as necessary.

In the process of the present invention, the major portion of the spent oil is removed from the oil pan 21 by a positive suction force exerted on the spent oil by external pump device 50. The spent oil passes through pump out line 40 and is ultimately conveyed to a suitable holding reservoir (not shown) until the spent oil can be recycled or disposed of in an environmentally sound manner.

When a thorough crankcase cleaning is not required, an appropriate amount of fresh motor oil can be introduced into the engine through fill line 54 and second outlet hose 26. Because the outlet hose 26 is in fluid communication with the internal lube oil distribution passage system of the engine, the fresh oil thus introduced passes through the machined passages in the internal lube oil distribution system to lubricate even remote, hard to reach surfaces of the moveable engine parts with fresh oil even prior to engine start up. The introduced oil which collects in the bottom of the oil pan is the appropriate quantity for recirculation through the lube oil distribution passage system when the engine is running and driving the internal oil pump 22.

The fresh motor oil is, preferably, introduced into the engine compartment under sufficient pressure to induce a spraying pattern in the oil as it exits the lube oil distribution passage system and enters the engine compartment. This spraying pattern will insure that the majority of the engine part surfaces are covered with lubricating oil. The pressure necessary to achieve this spraying pattern will vary with the type and configuration of the respective engine and the viscosity of the oil introduced. However, it is preferred that this introduction pressure be greater than the oil pressure during engine operation to insure adequate oil coverage. Pumping pressure during addition of the fresh oil is provided by the external pump device 50.

If desired or required, the oil filter 36 may be changed during the oil change process. This would preferably occur after removal of the spent oil from the crankcase.

When a complete crankcase flushing is desired, the suction and pressure hoses of the external pump device 50 are attached to the device 10 of the present invention. Once attached, flushing fluid can be introduced through fill line 34 and outlet hose 26 into the engine compartment through the internal lube oil distribution passage system. The pressure for the introduced flushing fluid is provided by the external pump device 50. The pressure with which the flushing fluid is introduced is sufficient to induce a spray pattern as the flushing fluid exits the internal lube oil distribution passage system so that the flushing fluid contacts the surfaces of the engine components and oil pan with sufficient force to dislodge a portion of the residual spent oil and contaminants by mechanical scrubbing action.

The flushing fluid may be introduced before, after, or during the pump-out step. Where the spent oil is extremely viscous, it is desirable to add a portion of the flushing fluid before or during the pump-out step to reduce the oil viscosity by dilution and improve the flow characteristics of the spent oil. Once the oil is diluted or if dilution is not required, the spent oil is pumped out to an appropriate holding tank in the manner described previously. The remaining flushing fluid is introduced to continue the cleaning process.

While a certain amount of residual spent oil and contaminants are removed merely by the mechanical scrubbing action of the spray, additional amounts can be dissolved or removed due to the sheeting action of the flushing fluid as it trickles down the oil pan walls and due to the chemical interaction between the residual spent oil and the flushing fluid.

The flushing fluid introduced is any material or composition which is miscible with motor oil and exhibits suitable detergency and cleaning characteristics but is inert to the oil pan, gaskets, and associated engine components. It is also preferable that the flushing fluid provides sufficient lubricity or sheeting action to enhance the sheeting action of the flushing fluid dislodging particulate contaminants and carrying them with the flushing fluid as it flows under gravity back to the oil pan. The flushing fluid employed is, preferably, one which is compatible with waste oil and is not detrimental in any subsequent waste oil recycling processes and one which does not deposit undesirable residual constituents which adhere to oil pan surfaces and engine components.

In the preferred embodiment, the flushing fluid employed in the present invention consists essentially of a hydrocarbon miscible with engine oil, a compatible detergent capable of improving the detergency of the flushing fluid and a lubricating additive capable of enhancing the sheeting action of the flushing fluid.

The hydrocarbon employed in the preferred embodiment is an organic fluid selected from the group consisting of high flash point kerosene and mixtures thereof. The flash point of the kerosene is preferably above about 150° F. It is to be understood that other fluids having similar characteristics to high flash point kerosene may be employed in admixture or substituted in the flushing fluid.

The detergent employed in the present invention is an organic fluid selected form the group consisting of butyl cellosolve, DOWFAX surfactants, and mixtures thereof. These and similar surfactants are employed in sufficient concentration to provide detergency in the flushing fluid.

The lubricating additive employed in the flushing fluid is, preferably, a methyl ester having a carbon chain between twelve and twenty carbon atoms or mixtures of such methyl esters in an amount sufficient to provide lubricity and sheeting action to the flushing fluid.

In including the lubricating additive in the flushing fluid of the present invention, it was believed that the lubricating additive would impart characteristics which would increase the sheeting action and cleaning characteristics of the flushing fluid. It has been found, quite unexpectedly that the flushing fluid of the present invention also imparts a residual surface lubricity, which is advantageous in that it provides preliminary lubricant to the engine parts as newly added fresh motor oil is added and circulated through the crankcase.

The introduced flushing fluid, dislodged contaminants and spent oil accumulate in the lowermost portion of the oil pan 21 during the spraying step. The flushing fluid, dislodged contaminants, and spent oil in the lowermost portion of the oil pan 21 as a result of spraying is pumped out in the manner described previous in connection with the spent oil. The pumped-out flushing fluid is directed into contact with various filtration media contained in the external pump device 50 to remove the contaminants and particulates dislodged from the engine components and contained in the flushing fluid. The filtered flushing fluid is then recirculated back to the fill hose 54 for reintroduction into the engine. If desired, the quality of the pumped out material can be tested or viewed to determine the effectiveness of the cleaning process. Depending on the effectiveness of the cleaning process, recirculation of flushing fluid continue as long can as necessary until most of the undesirable contaminants have been removed.

Once the flushing fluid recirculation is completed, the flushing fluid is pumped out to a suitable holding tank and an amount of fresh oil appropriate for the respective internal combustion engine is introduced into the engine in the manner described previously under sufficient pressure to contact the newly cleaned crankcase components and relubricate them.

After the fresh oil has been added, the coupling members can be disconnected and the engine operated in the normal manner. The present invention provides a cleaner environment by the virtual elimination of oil vapors inhaled by the operator, a simplified, high speed oil change process and an enhanced cleaning process in which greater amounts of residual spent oil and contaminants can be removed in a manner which reduces the time necessary to accomplish an oil change, the mess associated therewith, and provides a cleaner crank case environment for the fresh motor oil. This improves motor filter life and improves engine performance.

Having described the process of the present invention, what is claimed is:

1. A device for facilitating flushing and scrub cleaning of movable parts in an internal combustion engine having an oil pan with a drain plug opening an internal lube oil distribution passage system, comprising:

an oil filter adapter to be sealingly connected to an engine oil filter mounting boss located on the internal combustion engine, said adapter having at least two nozzles, a first nozzle in fluid communication with an engine oil pump located in the oil pan and a second nozzle in fluid communication with the internal lube oil distribution passage system of the engine;

a remote oil filter mounting boss having first and second apertures and a mounting bracket attached thereto, said mounting bracket positioned on the engine remote from said engine oil filter mounting boss;

an oil filter removably mounted on said remote oil filter mounting boss;

a first inlet hose connected to said first nozzle and said first aperture of said mounting bracket;

a second outlet hose connected to said second nozzle and said second aperture on said mounting bracket;

a pump-out line connected to the drain plug opening having a coupling member at a remote end, said coupling member adapted to removably contact an external pump device; and a fill line connected to said second outlet hose said fill line having a coupling member attached at a remote end, said coupling member adapted to removably contact said external pump device.

2. A process for changing oil in an internal combustion engine equipped with the oil change device, capable of facilitating flushing and scrub cleaning of moveable parts in an internal combustion engine having an oil pan with a drain plug opening an internal lube oil distribution passage system, the oil change device including:

an oil filter adapter adapted to be sealingly connected to an engine oil filter mounting boss located on the internal combustion engine, said adapter having at least two nozzles, a first nozzle in fluid communication with an engine oil pump located in the oil pan and a second nozzle in fluid communication with the internal lube oil distribution passage system of the engine;

a remote oil filter mounting boss having first and second apertures and a mounting bracket attached thereto, said mounting bracket positioned on the engine remote from said engine oil filter mounting boss;

an oil filter removably mounted on said remote oil filter mounting boss;

a first inlet hose connected to said first nozzle and said first aperture of said mounting bracket;

a second outlet hose connected to said second nozzle and said second aperture on said mounting bracket;

a pump-out line connected to the drain plug opening having a coupling member at a remote end, said coupling member adapted to removably contact an external pump device; and a fill line connected to said second outlet hose said fill line having a coupling member attached at a remote end, said coupling member adapted to removably contact said external pump device;

the process comprising the steps of:

connecting said pump-out line and said fill line to said external pump device;

removing spent oil from the oil pan by applying a suitable suction force through said pump-out line on said spent oil contained in the oil pan, said suction force exerted by said external pump device;

after said spent oil is removed, introducing a measured amount fresh oil into the engine through the internal lube oil distribution passage system in fluid communication with said fill line, said fresh oil introduced under sufficient pressure to produce a spray pattern sufficient to permit contact between said fresh motor oil and the movable engine parts; and uncoupling said pump-out line and said fill line from said external pump device after said fresh oil is introduced.

3. The process of claim 2 further comprising the steps of:

introducing a flushing fluid through said fill line and the internal lube oil distribution passage system, said flushing fluid under sufficient pressure to create a spray pattern whereby said flushing fluid contacts exposed surfaces of the moveable engine parts and the oil pan surfaces;

removing spent oil and introduced flushing fluid from the oil pan through said pump-out line.

4. The process of claim 3 wherein said flushing fluid is recirculated through said external pump device and reintroduced into the engine through said fill line.

5. The process of claim 4 wherein said recirculated flushing fluid is brought into contact with said oil filter prior to reintroduction into the engine.

6. The process of claim 4 wherein said flushing fluid is brought contact with the external filtration media prior to reintroduction into the engine.

7. The process of claim 3 wherein said flushing fluid consists essentially of:

an organic fluid selected from the group consisting of kerosene having a flash point above about 150° F.;

an additive selected from the group consisting of DOWFAX, butyl cellosolve and mixtures thereof present in an amount sufficient to enhance detergency action of said flushing fluid; and a lubricant additive selected form the group consisting of methyl esters with carbon chains having between about twelve and about twenty carbon atoms, said lubricant additive being present in an amount sufficient to enhance sheeting action of said flushing fluid.

8. A device for facilitating oil change and relubrication of moveable parts in an internal combustion engine having an oil pan with a drain plug opening and an internal lube oil distribution passage system, comprising:

an oil filter adapter to be sealingly connected to an engine oil filter mounting boss located on the internal combustion engine, said adapter having at least two nozzles, a first nozzle in fluid communication with an engine oil pump located in the oil pan and a second nozzle in fluid communication with the internal lube oil distribution passage system of the engine;

a remote oil filter mounting boss having first and second apertures and a mounting bracket attached thereto, said mounting bracket positioning on the engine remote from said engine oil filter mounting boss;

an oil filter removably mounted on said remote oil filter mounting boss;

a first inlet hose connected to said first nozzle and said first aperture of said mounting bracket;

a second outlet hose connected to said second nozzle and said second aperture on said mounting bracket;

a pump-out line connected to the drain plug opening having a coupling member at a remote end, said coupling member adapted to removably contact an external pump device; and a fill line connected to said second outlet hose said fill line having a coupling member attached at a remote end, said coupling member adapted to removably contact said external pump device.

* * * * *